United States Patent [19]

Engel

[11] Patent Number: 4,517,775

[45] Date of Patent: May 21, 1985

[54] TELESCOPING SUPPORT APPARATUS FOR CONTAINERS

[76] Inventor: Thomas H. Engel, 3040 SW. 129th, Oklahoma City, Okla. 73170

[21] Appl. No.: 503,324

[22] Filed: Jun. 10, 1983

[51] Int. Cl.[3] ..... E04H 12/00

[52] U.S. Cl. ..... 52/40; 52/118; 52/632; 248/DIG. 7

[58] Field of Search ..... 52/118, 632, 29, 40, 52/110; 248/507, 509, DIG. 7; 211/71, 78, 85

[56] References Cited

U.S. PATENT DOCUMENTS

| | | | |
|---|---|---|---|
| 2,448,456 | 8/1948 | Niskanen et al. | 248/156 |
| 2,596,541 | 5/1952 | Farquharson | 248/DIG. 7 |
| 2,819,547 | 1/1958 | Clements, Jr. | 40/125 |
| 2,937,760 | 5/1960 | Williams | 211/71 |
| 2,971,739 | 2/1961 | Kirkland | 248/DIG. 7 |
| 3,079,119 | 2/1963 | Brooks | 248/146 |
| 3,173,547 | 3/1965 | Alissandratos | 211/71 |
| 3,178,142 | 4/1965 | Koch | 248/146 |
| 3,235,094 | 2/1966 | Otto et al. | 211/71 |
| 3,527,355 | 9/1970 | Boyer | 211/71 |
| 3,638,802 | 2/1972 | Westerfield | 211/71 |
| 3,642,145 | 2/1972 | Shelton | 211/78 |
| 3,675,783 | 7/1972 | Reese | 211/71 |
| 3,952,463 | 4/1976 | Lane | 52/632 X |

FOREIGN PATENT DOCUMENTS

| | | | |
|---|---|---|---|
| 270463 | 5/1927 | United Kingdom | 52/632 |

*Primary Examiner*—Carl D. Friedman
*Assistant Examiner*—Naoko N. Slack
*Attorney, Agent, or Firm*—Bill D. McCarthy

[57] ABSTRACT

A telescoping support apparatus for supporting at least one refuse container, the support apparatus comprising a ground cylinder disposable in the ground and having an upper end portion extendible a selected distance above the surface of the ground; a support cylinder supported by the ground cylinder and slidably movable between a retracted position within the ground cylinder and an extended position substantially above the surface of the ground, the support cylinder having an upper portion and a lower portion, the upper portion having an outside diameter less than the outside diameter of the lower portion so that a support shoulder is formed at the junction of the upper and lower portions, the lower portion having a first detent slot formed therein; first stop means supported within the lower portion of the support cylinder for selectively locking the support cylinder in the extended position, the first stop means pivotally supported in the lower portion of the support cylinder so that an end portion of the first stop means is selectively extendible through the first detent slot of the lower portion of the support cylinder and prevents movement of the support cylinder to its retracted position when the first stop means is extended through the first detent slot, the first stop means selectively removable from the first detent slot to permit the support cylinder to be retracted into the ground cylinder; support means slidably disposed about the support cylinder for supporting the container thereon, the support means adapted to engage the support shoulder of the support cylinder when the support cylinder is in the extended position and to engage the upper end portion of the ground cylinder when the support cylinder is in the retracted position; and handle means secured to the upper portion of the support cylinder for selectively moving the support cylinder between the extended position and the retracted position.

29 Claims, 5 Drawing Figures

TELESCOPING SUPPORT APPARATUS FOR CONTAINERS

BACKGROUND OF THE INVENTION

1. Field of the Invention

The present invention relates to a container support apparatus, and more particularly but not by way of limitation, to a telescoping support apparatus for supporting and retaining containers such as refuse containers.

2. Discussion of the Prior Art

Containers used for refuse and garbage are generally located adjacent the rear area of a dwelling. In many instances the resident of the dwelling must move the container to a designated location in order to have the contents of the container picked up by a collection service. When the containers are positioned at the designated location, such as a curb area, the containers are often upset by wind or by domestic animals seeking food from the contents of the containers. While holders and support apparatus for refuse or garbage containers are generally known in the art, the prior art support apparatus, if positioned in an area in front of a dwelling such as adjacent curbing, would detract from the aesthetic qualities of the dwelling, as well as forming an obstruction in the portion of the yard containing the apparatus. Thus, most of the prior art holder and support apparatus are adapted to be permanently secured in the ground in the area where the refuse or garbage containers are stored.

While the prior art containers have met with a limited amount of success, such devices do not overcome the problem of the upsetting of the containers by the wind or by the domestic animals when the containers are placed in the designated pickup area. Thus, it would be highly desirable to provide a support apparatus for garbage or refuse containers in the pickup area which would prevent the wind or domestic animals from overturning such containers, while allowing the container to be substantially removed from view when not in use.

SUMMARY OF THE INVENTION

The present invention relates to a telescoping support apparatus for refuse containers. The telescoping support apparatus is positioned at a designated pick up area the containers, such as along the curbing in front of a dwelling, and substantially prevents wind and domestic animals from upsetting the containers. Further, the support apparatus can be retracted into the ground so that it is substantially removed from view when not in use.

Broadly, the present invention relates to a telescoping support device for supporting at least one refuse container comprising a ground cylinder disposable in the ground; a support cylinder supported by the ground cylinder and having a detent slot formed in a lower portion thereof, the support cylinder being slidably movable between a retracted position within the ground cylinder and an extended position substantially above the surface of the ground; a stop assembly pivotally supported in the lower portion of the support cylinder so that one end thereof is extendible through the detent slot of the support cylinder when the support cylinder is in the extended position; a support member slidably disposed about the support cylinder for supporting the container thereon; and a handle secured to the upper portion of the support cylinder for selectively moving the support cylinder between the extended position and the retracted position.

An object of the present invention is to provide a support apparatus for a container to prevent the container from being upset by wind or domestic animals.

Another object of the present invention is to provide a support apparatus for a container which can be permanently affixed in a designated pickup location and which can be substantially hidden from view when not in use.

Another object of the present invention is to provide an improved, inexpensive support apparatus for containers which is adapted to be anchored within the ground and which will readily support the containers regardless of the slope or terrain of the supporting ground surface.

Other objects, features and advantages of the present invention will become clear upon reading the following detailed description in conjunction with the drawings and the appended claims.

DESCRIPTION OF THE INVENTION

Figure 1:
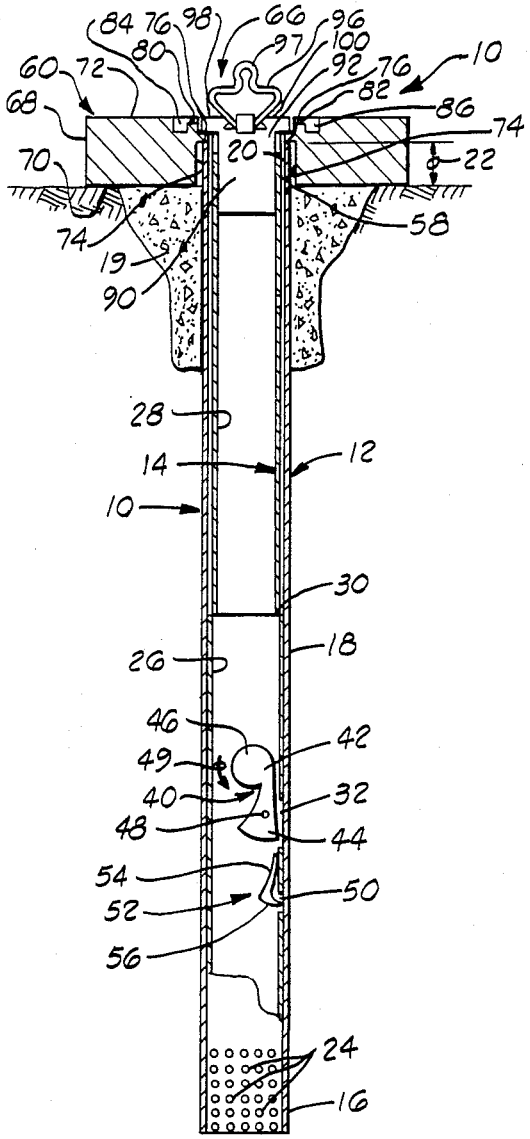
FIG. 1 is an elevational, cutaway view of the telescoping support apparatus of the present invention wherein the telescoping support apparatus is in a retracted mode so that the top portion of the apparatus is disposed substantially adjacent with the surrounding terrain.
Figure 2:
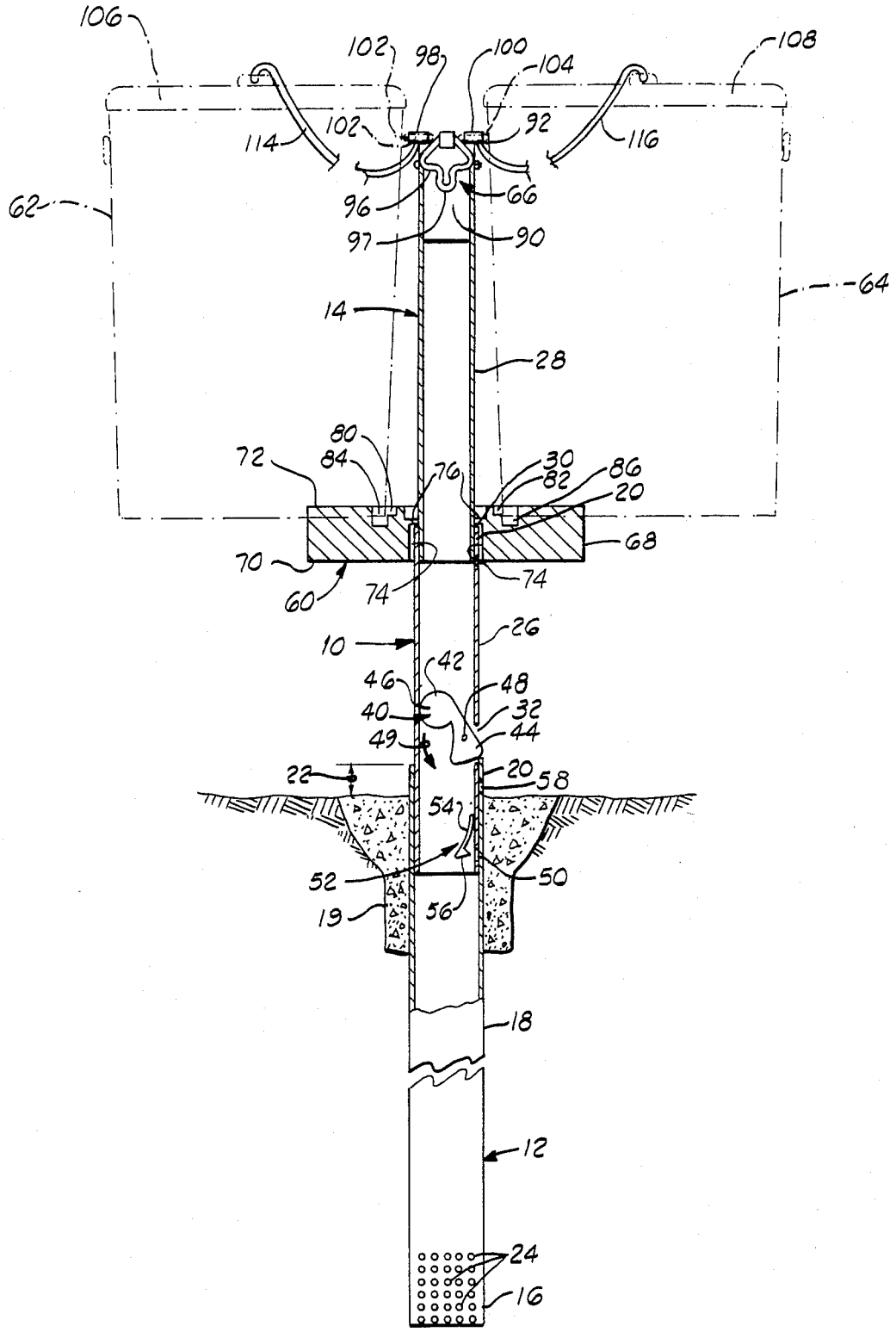
FIG. 2 is an elevational, cutaway view of the telescoping support apparatus of the present invention wherein the telescoping support apparatus is in its extended mode for supporting a pair of refuse cans, the refuse cans being illustrated in phantom.

Referring now to the drawings, and particularly to FIGS. 1 and 2, shown therein is a telescoping support apparatus 10 constructed in accordance with the present invention. The telescoping support apparatus 10 comprises a stationary ground cylinder 12 and a support cylinder 14 supported by the ground cylinder 12 and slidably movable between a retracted position within the ground cylinder 12 (substantially as shown in FIG. 1) and an extended position substantially above the surface of the ground (substantially as shown in FIG. 2). The stationary ground cylinder 12 is provided with a lower end portion 16, a medial portion 18 and an upper end portion 20. The support cylinder 14 is positioned within a hole in the ground and secured in place by any suitable means, such as concrete 19, so that the upper end portion 20 of the support cylinder 14 extends a selected distance 22 above the surface of the ground. A plurality of apertures 24 are formed in the lower end portion 16 of the stationary ground cylinder 12 to ensure proper drainage of water which may accumulate in the stationary ground cylinder 12.

The support cylinder 14 is provided with a lower portion 26 and an upper portion 28. The upper portion 28 of the support cylinder 14 has an outside diameter which is less than the outside diameter of the lower portion 26 so that a support shoulder 30 is formed at the junction of the lower and upper portions 26, 28. A first detent slot 32 is formed in the lower portion 26 of the support cylinder 14.

Any suitable means can be employed to fabricate the lower and upper portions 26, 28 of the support cylinder 14 so as to provide the support shoulder 30 at the junction of the lower and upper end portions 26, 28. For example, the support cylinder 14 can be formed of two separate tubular members, the tubular member forming the lower portion 26 having an inside diameter substantially corresponding to the outside diameter of the tubular member forming the upper portion 28 of the support cylinder 14. Thus, upon positioning one end of the tubular member forming the upper portion 28 of the support cylinder 14 into one end of the tubular member forming the lower portion 26 of the support cylinder 14, and connecting the two tubular members by any suitable means such as welding, the resulting interconnection of the two tubular members cooperate to form the support shoulder 30 of the support cylinder 14.

A first stop assembly 40 is pivotally connected within the lower portion 26 of the support cylinder 14 for selectively locking the support cylinder 14 when the support cylinder 14 is in the extended position. The first stop assembly 40 comprises a dog detent member 42 having a first end portion 44 and a second end portion 46. The first end portion 44 of the dog detent member 42 is pivotally supported in the lower portion 26 of the support cylinder 14 by any suitable means, such as pivot pin 48, so that the first end portion 44 of the dog detent member 42 is extendible through the detent slot 32 formed in the lower portion 26 of the support cylinder 14 when the support cylinder 14 is withdrawn from the stationary ground cylinder 12 to a position where the detent slot 32 is disposed above the upper end portion 20 of the stationary ground cylinder 12. The dog detent member 42 is biased to rotate in the direction indicated by the arrow 49 so that the first end portion 44 of the dog detent member 42 extends through the detent slot 32 and engages the upper end portion 20 of the ground cylinder 12. Thus, the first end portion 44 of the dog detent member 42, the detent slot 32 in the lower portion 26 of the support cylinder 14, and the upper end portion 20 of the stationary ground cylinder 12 cooperate to secure the support cylinder 14 in the extended position shown in FIG. 2.

Because the dog detent member 42 is biased, application of pressure on the first end portion 44 of the dog detent member 42 in an inwardly direction causes the dog detent member 42 to rotate inwardly into the lower portion 26 of the support cylinder 14 and to disengage the upper end portion 20 of the stationary ground cylinder 12 so that the support cylinder 14 can be moved to its retracted position within the stationary ground cylinder 12. Any suitable means can be employed for biasing the dog detent member 42, such as by increasing the weight of the second end portion 46 of the dog detent member 42 and pivotally connecting the dog detent member 42 to the lower portion of the support cylinder 14 with the pivot pin 48 via the second end portion 46 of the dog detent member 42.

In order to prevent unintentional removal of the support cylinder 14 from the stationary ground cylinder 12 as the support cylinder 14 is moved to the extended position, a second detent slot 50 is formed in the lower portion 26 of the support cylinder 14 a distance below the first detent slot 32. A second stop assembly 52 is connected within the lower portion 26 of the support cylinder 14 by any suitable means, such as welding, screws and the like, so as to be positioned a distance below the dog detent member 42 of the first stop assembly 40. The second stop assembly 52 selectively engages the stationary ground cylinder 12 to prevent inadvertent removal of the support cylinder 14 from the stationary ground cylinder 14.

The second stop assembly 52 comprises a body portion 54 and an ear member 56 supported by the body portion 54. The ear member 56 is aligned within the second detent slot 50 of the support cylinder 14 and the body portion 54 is biased so as to direct the ear member 56 through the second detent slot 50 and into engagement with the stationary ground cylinder 12 via a third detent slot 58 formed in the upper end portion 20 of the stationary ground cylinder 12 when the support cylinder 14 is moved to the extended position. The lower edge portion of the ear member 56 is provided with a suitable configuration such that when the support cylinder 14 is withdrawn from the stationary ground cylinder to the extent that the ear member 56 engages the third detent slot 58 in the upper end portion 20 of the stationary ground cylinder 12, application of either a downward force on the support cylinder 14 (or an inwardly directed force on the ear member 56) will cause the ear member 56 to retract from the third detent slot 58 in the upper end portion 20 of the stationary ground cylinder 14 so that the support cylinder 14 can be lowered to a position where the dog detent member 42 of the first stop assembly 40 engages the stationary ground cylinder 12 to secure same in the extended position as shown in FIG. 2.

The telescoping support apparatus 10 further comprises a support assembly 60 slidably disposed about the support cylinder 14 for supporting containers (such as refuse containers 62 and 64 shown in phantom in FIG. 1), and a handle assembly 66 secured to the upper portion 28 of the support cylinder 14 for selectively moving the support cylinder 14 between the extended position and the retracted position.

The support assembly 60 comprises a body member 68 having a lower side 70 and an upper side 72. A substantially centrally disposed bore 74 extends through the body member 68 from the lower side 70 to the upper side 72, the bore 74 having a diameter somewhat greater than the outside diameter of the stationary ground cylinder 12 so that the body member 68 of the support assembly 60 can wobble and be angularly disposed with respect to the stationary ground cylinder 12 to compensate for slight variations is the surrounding ground in which the stationary ground cylinder 12 is implanted. This wobbling variation enables one to maintain the refuse containers, such as the refuse containers 62 and 64 shown in phantom in FIG. 2, in a substantially upright position regardless of the slight variations in the ground surface or terrain in which the telescoping support apparatus 10 of the present invention is employed.

Figure 4:
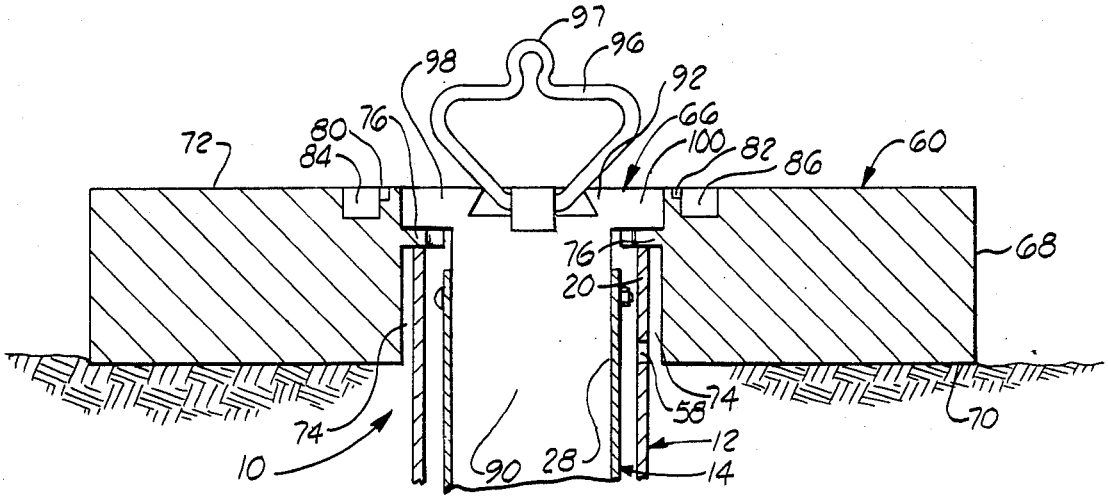
FIG. 4 is a fragmentary, cross sectional view of the telescoping support apparatus of the present invention taken along the lines 4—4 of FIG. 3 and illustrating the handle of the apparatus in a raised position.
Figure 5:
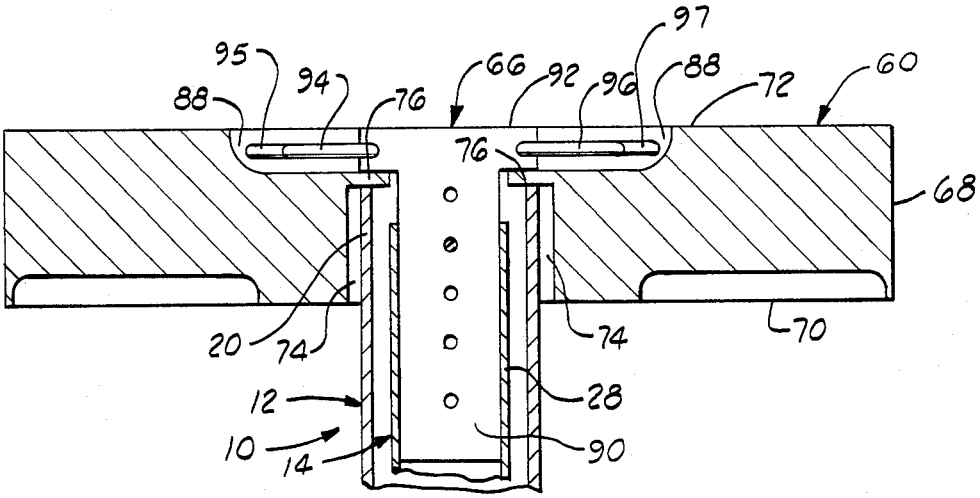
FIG. 5 is a partially broken, cross sectional view of the telescoping support apparatus of the present invention taken along the lines 5—5 of FIG. 3.

The body member 68 further comprises a flange 76 formed to extend a selected distance into the bore 74 as more clearly shown in FIGS. 4 and 5. The flange 76 formed in the body member 68 engages the support shoulder 30 of the support cylinder 14 when the support cylinder 14 is in the extended position (as shown in FIG.

2); and the flange 76 engages the upper end 20 of the stationary ground cylinder 12 when the support cylinder 14 is in the retracted position (as shown in FIGS. 1, 4 and 5.).

Figure 3:
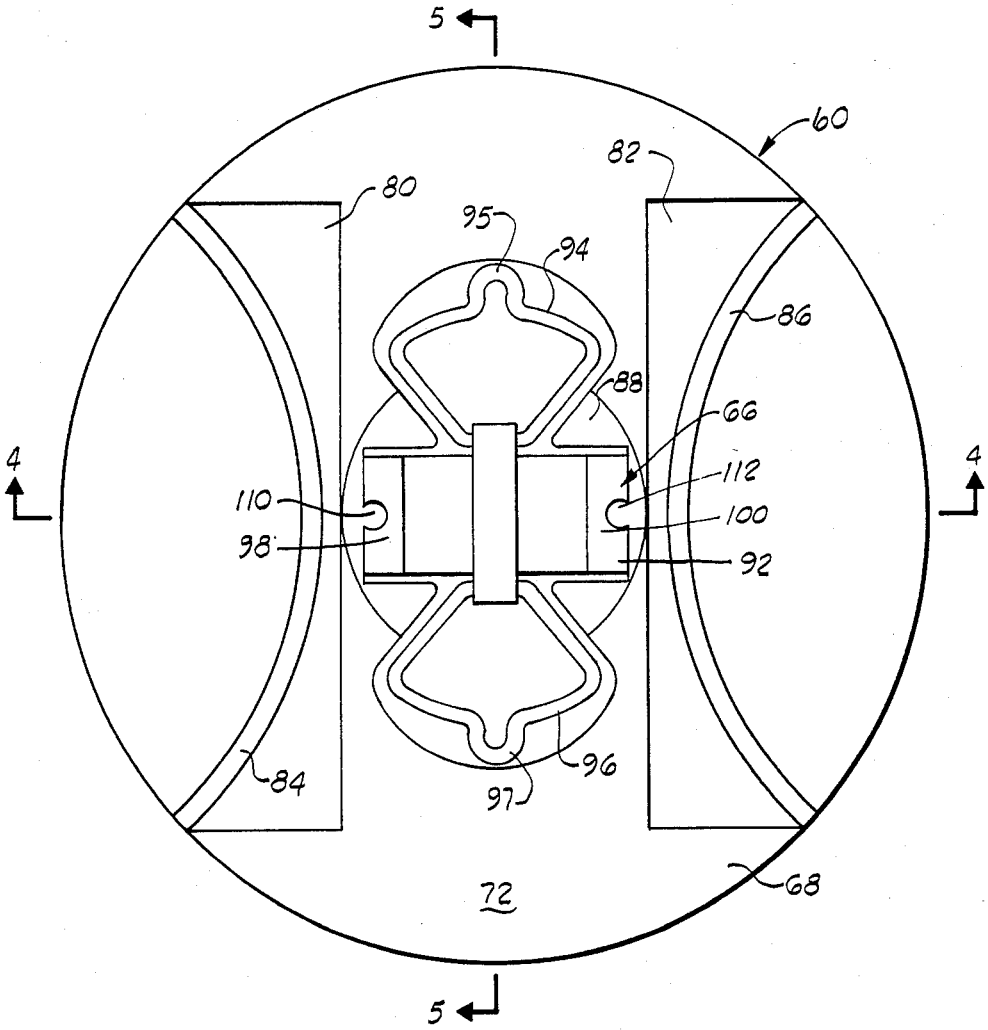
FIG. 3 is a top plan view of the telescoping support apparatus of the present invention when the telescoping support apparatus is in its retracted mode as illustrated in FIG. 1.

The upper side 72 of the body member 68 is provided with oppositely disposed recessed portions 80, 82 formed therein (see FIGS. 3 and 4) such that the recessed portions 80, 82 have a surface substantially normally disposed to the elongated axis of the stationary ground cylinder 12 and the support cylinder 14. The recessed portions 80 and 82 formed in the body member 68 are each provided with an arcuate shaped groove segment, such as groove segments 84 and 86. The recessed portions 80 and 82 of the body member 68 are adapted to receive and support substantially rectangularly shaped refuse containers; whereas the arcuate shaped groove segments 84 and 86 are designed to receive the lower rim of substantially circularly shaped containers so that the containers are stabilized on the body member 68 of the support assembly 60. The upper side 72 of the body member 68 is also provided with a centrally disposed recessed portion 88 positioned between the recessed portions 80 and 82 substantially as shown in FIGS. 3 and 5. The recessed portion 88 is formed in a central portion of the upper side 72 of the body member 68 and the handle assembly 66 can be positioned within the recessed portion 88 when the handle assembly 66 is in a retracted position so that the handle assembly 66 does not extend above the upper side 72 of the body member 68.

The handle assembly 66, illustrated in FIGS. 4 and 5 as a substantially T-shaped assembly, comprises a throat portion 90 and a substantially normally disposed upper portion 92. The throat portion 90 of the handle assembly 66 is positionable within the upper portion 28 of the support cylinder 14 and secured thereto by any suitable means, such as by a bolt 93 which is extended through axially aligned holes in the walls of the upper portion 28 of the support cylinder 14. A plurality of axially aligned holes 95 are disposed through opposing walls of the throat portion 90 and are spaced apart at predetermined intervals, such as 1 inch each. By aligning the holes of the upper portion 28 with a selected pair of the holes 95, and by extending the bolt 93 therethrough, the throat portion 90 is firmly secured to the upper portion 28 of the support cylinder 14. The selection of the holes 95 determines the height of the upper portion 92 above the upper side 72 of the body member 68 of the support assembly 60 when the latter is disposed in the position shown by FIG. 2. That is, the throat portion 90 is connectable to the upper portion 28 of the support cylinder 14 and extends therefrom a preselected distance. This feature permits adjustment of the telescoping support apparatus 10 to accommodate different sizes of garbage cans, as will become clear in the description following.

The upper portion 92 of the handle assembly 66 is disposable within the upper portion of the bore 74 and supported by the flange 76 therein when the support cylinder 14 is in its retracted position within the stationary ground cylinder 12. The handle assembly 66 further comprises a pair of oppositely disposed handle members 94 and 96 which are pivotally connected to the upper portion 92 of the handle assembly 66 so that the handles 94 and 96 can be selectively disposed in the recessed portion 88 formed in the upper side 72 of the body member 68 when the support cylinder 14 is in its retracted position within the stationary ground cylinder 12 (as illustrated in FIGS. 4 and 5); or the handle member 94 and 96 can be selectively pivoted upwardly for grasping by a person to move the support cylinder 14 to its extended position with respect to the stationary ground cylinder 12 substantially as shown in FIG. 2.

The handle members 94 and 96, illustrated as substantially triangularly shaped members, are provided with a bag retaining ring 95 and 97, respectively. The bag retaining rings are formed in the gripping portions of the handle members 94, 96 and openly communicate with the openings formed by the handle members 94 and 96. Thus, a neck portion of refuse bags (formed below a knot in the bags) can be secured to the support apparatus 10 by the bag retaining rings 95 and 97 when the support cylinder 14 is in the extended position.

To secure the upper portion of the refuse cans (such as the refuse cans 62 and 64 shown in phantom in FIG. 2) to the handle assembly 66, and to further stabilize the refuse containers 62 and 64 with respect to the telescoping support apparatus 10 when same is in its extended mode, a pair of handle engaging rib members 98 and 100 (see FIG. 2) are formed on the upper portion 92 of the handle assembly 66 so as to be disposed substantially adjacent the refuse cans. The handle engaging rib members 98 and 100 are each constructed so that a handle of a refuse can, such as handles 102 and 104 of the refuse container 62 and 64 (shown in phantom in FIG. 2), can be positioned over one of the handle engaging rib members 98 and 100 to secure the refuse cans to the handle assembly 66 when the support cylinder 14 is in the extended mode.

In order to secure the lids of the refuse container to the telescoping support apparatus 10, such as the lids 106 and 108 of the refuse containers 62 and 64 shown in phantom in FIG. 2, the upper portion 92 of the handle assembly 66 is provided with oppositely disposed openings 110 and 112 (see FIG. 3) openly communicating with the outer edge of the upper portion 92 of the handle assembly 66. Ropes 114 and 116, each having a knot (not shown) formed therein are positioned in the opening 110 and 112, respectively, such that the knots secure the ropes 114 and 116 in the openings 110 and 112. A second end of the rope 114 is secured to the lid 106 of the container 62, and a second end of the rope 116 is secured to the lid 108 of the container 64. Thus, the lids of the containers supported on the support apparatus 10 are secured to the support apparatus 10 and substantially prevents loss or damage to the lids of the refuse containers.

In the operation of the telescoping support apparatus 10 of the present invention, and assuming that the apparatus 10 is in its retracted position as shown in FIG. 1, an operator need merely grasp the handle members 94 and 96 of the handle assembly 66 and raises the support cylinder 14 upwardly until the first detent slot 32 in the support cylinder 14 clears the upper end portion 20 of the stationary ground cylinder 12. When the first detent slot 32 is clear of the upper end portion 20 of the stationary ground cylinder 12, the dog detent member 42 of the first stop assembly 40 pivots in the direction of the arrow 49 so that the first end portion 44 of the dog detent member 42 extends outwardly through the first detent slot 32. Thereafter, by lowering the support cylinder 14, the first end portion 44 of the dog detent member 42 engages the upper end portion 20 of the stationary ground cylinder 12 and secures the support cylinder 14 in its extended position. Meanwhile, the support assembly 60 slides down the upper portion 28 of the support cylinder 14 and come to rest on the support shoulder 30 formed at the junction of the lower portion 26 and the upper portion 28 of the support cylinder 14. In this position, the refuse containers (such as refuse containers 62 and 64 shown in phantom in FIG. 2) are set upon the support assembly 60 so that the rims of the bottom portions of the containers engage the arcuate shaped groove segments 84 and 86 formed in the upper side 72 of the body member 68. The handle members 94 and 96 of the refuse containers 62 and 64 can then be disposed over the respective handle engaging rib members 98 and 100 to stabilize the refuse containers on the support assembly 60. In addition, other means can be employed for securing the refuse containers on the telescoping support apparatus 10 of the present invention, such as straps and the like.

To return the telescoping support apparatus 10 to its retracted position, the refuse containers 62 and 64 are removed and the stationary ground cylinder 12 is raised via the handle members 94 and 96 so that the first detent slot 32 formed in the support cylinder 14 clears the support shoulder 30 formed between the lower and upper portions 26, 28 of the support cylinder 14. The operator then pushes the first end portion 44 of the dog detent member 42 inwardly so that the first end portion 44 clears the upper end 20 of the stationary ground cylinder 12 as the support cylinder 14 is lowered into the stationary ground cylinder 12. The support assembly 60 will slide on the upper portion 28 of the support cylinder 14 until it resumes the position illustrated in FIG. 1 when the support cylinder 14 is fully retracted within the stationary ground cylinder 12.

The unintentional removal of the support cylinder 14 from the stationary ground cylinder 12 (as the support cylinder 14 is moved to either the extended position or returned to the retracted position as described above) is prevented by the second stop assembly 52. When the support cylinder 14 is moved upwardly so as to disengage the dog detent member 42 from the support cylinder 14 and the first detent slot 32 is disposed a selected distance about the support shoulder 30 of the support cylinder 14, the ear member 56 of the second stop assembly 50 extends through the second detent slot 50 formed in the lower portion 26 of the support cylinder 14 and engages the stationary ground cylinder 12 via the third detent slot 58 so that continued upward movement of the support cylinder 14 is prevented.

As previously stated, the support assembly 60 is designed such that it can assume various pivotal positions relative to the upper portion 28 of the support cylinder 14 (and thus the stationary ground cylinder 12) so that the support assembly 60 remains in a substantially level position when uneven or sloped terrain is encountered. Further, this pivoting feature enables the refuse containers (such as the refuse containers 62 and 64 illustrated in phantom in FIG. 2) to be maintained in a substantially upright stable position when the telescoping support apparatus 10 is positioned in sloped terrain.

When the refuse containers supported by the telescoping support apparatus 10 are refuse bags, the operator will generally first move the support apparatus 10 to the extended position. Thereafter, the operator secures the bags to the handle members 94 and 96 via the bag retaining rings 95 and 97 of the handle members 94 and 96 so that the bags are secured to and supported by the telescoping support apparatus 10.

It is clear that the present invention is well adapted to carry out the objects and attain the ends and advantages mentioned as well as those inherent therein. While presently preferred embodiments of the invention has been described for purposes of this disclosure, numerous changes may be made which will readily suggest themselves to those skilled in the art and which are encompassed within the spirit of the invention disclosed and as defined in the appended claims.

What is claimed is:

1. A telescoping support device for supporting at least one refuse container, comprising:

a ground cylinder disposable in the ground and having an upper end portion extendible a selected distance above the surface of the ground;

a support cylinder supported by the ground cylinder and slidably movable between a retracted position within the ground cylinder and an extended position substantially above the surface of the ground, the support cylinder having an upper portion and a lower portion, the upper portion having an outside diameter less than the outside diameter of the lower portion so that a support shoulder is formed at the junction of the upper and lower portions, the lower portion having a first detent slot formed therein;

first stop means supported within the lower portion of the support cylinder for selectively locking the support cylinder in the extended position, the first stop means pivotally supported in the lower portion of the support cylinder so that an end portion of the first stop means is selectively extendible through the first detent slot of the lower portion of the support cylinder and prevents movement of the support cylinder to its retracted position when the first stop means is extended through the first detent slot, the first stop means selectively removable from the first detent slot to permit the support cylinder to be retracted into the ground cylinder;

support means slidably disposed about the support cylinder for supporting the container thereon, the support means adapted to engage the support shoulder of the support cylinder when the support cylinder is in the extended position and to engage the upper end portion of the ground cylinder when the support cylinder is in the retracted position; and handle means secured to the upper portion of the support cylinder for selectively moving the support cylinder between the extended position and the retracted position.

2. The telescoping support device of claim 1 wherein the first stop means comprises:

a dog detent member pivotally supported in the lower portion of the support cylinder so that an end of the dog detent member is aligned with and extendible through the first detent slot, the dog detent member being biased to rotate in the direction of the first detent slot and into supporting engagement with the upper end portion of the ground cylinder when the support cylinder is in an extended position, the dog detent member being movable for disengagement with the first detent slot and the upper end portion of the ground cylinder when the support cylinder is in its retracted position.

3. The telescoping support device of claim 1 further comprising:

second stop means supported within the lower portion of the support cylinder a distance below the first stop means for selectively engaging the ground cylinder and preventing inadvertent removal of the support cylinder from the ground cylinder.

4. The telescoping support device of claim 3 wherein the support cylinder is provided with a second detent slot formed a distance below the first detent slot, the second detent slot being aligned with the second stop means, and the ground cylinder is provided with a third detent slot formed in the upper end portion thereof, the third detent slot alignable with the second detent slot when the support cylinder is extended from the ground cylinder, and wherein the second stop means comprises:

a stop member having a body portion and an ear member supported by the body portion, the body portion being biased so as to direct the ear member through the second detent slot and into engagement with the ground cylinder via the third detent slot wherein the support cylinder is moved past the extended position within the ground cylinder.

5. The telescoping support device of claim 1 wherein the support means comprises:

a body member having a substantially centrally disposed bore extending therethrough, the body member characterized as having a lower side and an upper side, the bore having a diameter greater than the outside diameter of the ground cylinder; and a flange formed on the body member to extend a selected distance into the bore of the body member, the flange engages the upper end portion of the ground cylinder when the support cylinder is in the retracted position, the flange engaging the support shoulder of the support cylinder when the support cylinder is in the extended position.

6. The telescoping support device of claim 5 wherein the upper side of the body member is provided with at least one first recessed portion, the recessed portion having an arcuate shaped groove segment formed therein, the recessed portion and groove segment adapted to receive a lower portion of a container so as to stabilize the container on the body member.

7. The telescoping support device of claim 5 wherein the upper side of the body member is provided with oppositely disposed first recessed portions extending outwardly from the bore formed in the body member, the first recessed portions defining a surface substantially normal to the elongated axis of the ground cylinder and the support cylinder, the first recessed portions each having an arcuate shaped groove segment formed in the surface thereof, the arcuated shaped groove segments adapted to receive a lower rim of a container positioned thereon so as to stabilize the container on the body member.

8. The telescoping support device of claim 7 wherein the the first recessed portions are substantially rectangularly shaped recessed portions.

9. The telescoping support device of claim 8 wherein the body member is provided with a second recessed portion extending outwardly from the bore formed in the body member so as to be substantially normally disposed to the first recessed portions, the second recessed portion adapted to receive the handle means when the support cylinder is in the retracted position.

10. The telescoping support device of claim 9 wherein the handle means comprises:

a substantially T-shaped member having a throat portion and a substantially normally disposed upper portion, the throat portion connectable to the upper portion of the support cylinder such that in the retracted position of the support cylinder the normally disposed upper portion of the T-shaped member engages and is supported by the flange in the body member; and at least one handle member pivotally connected to the upper portion of the T-shaped member.

11. The telescoping support device of claim 10 wherein the handle member is provided with a gripping portion defining a handle opening therein, and wherein the handle means further comprises a bag retaining ring member formed in the gripping portion of the handle member and openly communicating with the handle opening, the bag retaining ring member adapted to receive a neck portion of a refuse bag formed below a knot therein for securing the refuse bag to the handle member.

12. The telescoping support device of claim 11 wherein the ground cylinder is provided with a plurality of apertures in a lower portion thereof.

13. The telescoping support device of claim 12 further comprising securing means formed on the upper portion of the T-shaped member for securing containers positioned on the body member of the support means to the upper portion of the T-shaped member via handles of the containers.

14. The telescoping support device of claim 13 wherein the upper portion of the T-shaped member is provided with oppositely disposed openings openly communicating with an outer edge portion of the upper portion of the T-shaped member, the opening adapted to secure a rope member to the T-shaped member for securing lids of refuse containers to the T-shaped member.

15. A telescoping support device for supporting at least one refuse container, comprising:

a ground cylinder disposable in the ground and having an upper end portion extendible a selected distance above the surface of the ground;

a support cylinder supported by the ground cylinder and slidably movable between a retracted position within the ground cylinder and an extended position substantially above the surface of the ground, the support cylinder having an upper portion and a lower portion, the upper portion having an outside diameter less than the outside diameter of the lower portion so that a support shoulder is formed at the junction of the upper and lower portions, the lower portion having a first detent slot formed therein;

first stop means supported within the lower portion of the support cylinder for selectively locking the support cylinder in the extended position, the first stop means comprising a dog detent member pivotally supported in the lower portion of the support cylinder so that an end of the dog detent member is extendible through the first detent slot of the lower portion of the support cylinder, the dog detent member biased to rotate toward the first detent slot and extend therethrough so that the dog detent member prevents the movement of the support cylinder to its retracted position when the dog detent member is extended through the first detent slot, the dog detent member rotatable from the first detent slot to permit passage of the support cylinder to its retracted position;

support means slidably disposed about the support cylinder for supporting the container thereon, the support means having an upper flange portion adapted to engage the support shoulder of the support cylinder when the support cylinder is in the extended position; and handle means secured to the upper portion of the support cylinder for selectively moving the support cylinder between the extended position and the retracted position.

16. The telescoping support device of claim 15 wherein the support means comprises:

a body member having a substantially centrally disposed bore extending therethrough, the body member characterized as having a lower side and an upper side, the bore having a diameter greater than the outside diameter of the ground cylinder; and a flange formed on the body member to extend a selected distance into the bore of the body member, the flange engaging the upper end portion of the ground cylinder when the support cylinder is in the retracted position and the support shoulder formed between the upper and lower portions of the support cylinder when the support cylinder is in the extended position.

17. The telescoping support device of claim 16 wherein the support cylinder is provided with a second detent slot formed a distance below the first detent slot, the ground cylinder is provided with a third detent slot formed in the upper end portion, the third detent slot being alignable with the second detent slot when the support cylinder is extended within the ground cylinder to a position above the extended position, and wherein the telescoping support device further comprises:

second stop means supported within the lower portion of the support cylinder a distance below the dog detent member of the first stop means for selectively engaging the ground cylinder via the second and third detent slots and preventing unintentional removal of the support cylinder from the ground cylinder as the support cylinder is moved to the extended position.

18. The telescoping support device of claim 17 wherein the second stop means comprises:

a stop member having a body portion and an ear member supported by the body portion, the body portion being biased so as to direct the ear member through the second detent slot and into engagement with the ground cylinder via the third detent slot when the support cylinder is moved past the extended position within the ground cylinder.

19. The telescoping support device of claim 17 wherein the upper side of the body member is provided with at least one first recessed portion, the recessed portion having an arcuate shaped groove segment formed therein, the recessed portion and groove segment adapted to receive a lower portion of a container so as to stabilize the container on the body member.

20. The telescoping support device of claim 17 wherein the upper side of the body member is provided with oppositely disposed first recessed portions extending outwardly from the bore formed in the body member, the first recessed portions defining a surface substantially normal to the elongated axis of the ground cylinder and the support cylinder, the first recessed portions each having an arcuate shaped groove segment formed in the surface thereof, the arcuated shaped groove segments adapted to receive a lower rim of a container positioned thereon so as to stabilize the container on the body member.

21. The telescoping support device of claim 20 wherein the the first recessed portions are substantially rectangularly shaped recessed portions.

22. The telescoping support device of claim 21 wherein the body member is provided with a second recessed portion extending outwardly from the bore formed in the body member so as to be substantially normally disposed to the first recessed portions, the second recessed portion adapted to receive the handle means when the support cylinder is in the retracted position.

23. The telescoping support device of claim 15 wherein the handle means comprises:

a substantially T-shaped member having a throat portion and a substantially normally disposed upper portion, the throat portion connectable to the upper portion of the support cylinder such that in the retracted position of the support cylinder the normally disposed upper portion of the T-shaped member engages and is supported by the flange in the body member; and at least one handle member pivotally connected to the upper portion of the T-shaped member.

24. The telescoping support device of claim 23 wherein the ground cylinder is provided with a plurality of apertures in a lower portion thereof.

25. The telescoping support device of claim 23 wherein the handle member is provided with a gripping portion defining a handle opening therein, and wherein the handle means further comprises a bag retaining ring member formed in the gripping portion of the handle member and openly communicating with the handle opening, the bag retaining ring member adapted to receive a neck portion of a refuse bag formed below a knot therein for securing the refuse bag to the handle member.

26. The telescoping support device of claim 25 further comprising handle engaging means formed on the upper portion of the T-shaped member for securing containers positioned on the body member of the support means to the upper portion of the T-shaped member.

27. The telescoping support device of claim 26 wherein the securing means comprises a pair of oppositely disposed handle engaging rib members formed on the upper portion of the T-shaped members, one of each of the rib members being disposed substantially adjacent a container positioned on the body member of the support means and adapt to have a handle of the container positioned thereover.

28. The telescoping support device of claim 23 wherein the handle member is provided with a gripping portion defining a handle opening therein, and wherein the handle means further comprises a bag retaining ring member formed in the gripping portion of the handle member and openly communicating with the handle opening, the bag retaining ring member adapted to receive a neck portion of a refuse bag formed below a knot therein for securing the refuse bag to the handle member.

29. The telescoping support device of claim 28 wherein the upper portion of the T-shaped member is provided with oppositely disposed openings openly communicating with an outer edge portion of the upper portion of the T-shaped member, the opening adapted to secure a rope member to the T-shaped member for securing lids of refuse containers to the T-shaped member.

* * * * *